US005412362A

United States Patent [19]

Ikeuchi

[11] Patent Number: 5,412,362

[45] Date of Patent: May 2, 1995

[54] DEFLECTION COIL AND FABRICATION METHOD THEREOF

[75] Inventor: Hiroshi Ikeuchi, Kyoto, Japan

[73] Assignee: Murata Mfg. Co., Ltd., Japan

[21] Appl. No.: 324,372

[22] Filed: Oct. 17, 1994

Related U.S. Application Data

[63] Continuation of Ser. No. 49,730, Apr. 20, 1993, abandoned.

[30] Foreign Application Priority Data

Apr. 24, 1992 [JP] Japan ..... 4-132029
Apr. 24, 1992 [JP] Japan ..... 4-132030

[51] Int. Cl.[6] ..... H01H 1/00; G09G 1/04; H01B 11/04; H01F 7/06

[52] U.S. Cl. ..... 335/213; 315/368.25; 140/71.5; 242/7.07; 29/605

[58] Field of Search ..... 335/210, 211, 212, 213; 358/248; 315/368.25; 140/71 B, 71.5, 92.01; 313/343, 440; 242/7.07, 7.09, 7.11; 29/605, 606

[56] References Cited

U.S. PATENT DOCUMENTS 4,152,685 5/1979 Renders ..... 335/213
4,260,974 4/1981 Nelle ..... 335/213
4,430,139 2/1984 Baverstock ..... 156/353
4,484,166 11/1984 Osinga ..... 335/213
4,586,667 5/1986 Rodenbeck ..... 242/7.03
4,785,272 11/1988 Osseyran ..... 335/213
4,884,759 12/1989 Nelle ..... 242/7.14
4,902,994 2/1990 Kawamura ..... 335/210
5,205,427 4/1993 Crago ..... 220/4.15
5,258,734 11/1993 Tamai ..... 335/213

FOREIGN PATENT DOCUMENTS 0208532 9/1987 Japan ..... 313/440
0255137 10/1989 Japan ..... 313/440
2012478 7/1979 United Kingdom ..... 335/210

*Primary Examiner*—Leo P. Picard
*Assistant Examiner*—Stephen T. Ryan
*Attorney, Agent, or Firm*—Rogers, Howell & Haferkamp

[57] ABSTRACT

A deflection coil is formed into a saddle shape by winding up a conductive wire ribbon in layers, such that the layered wire ribbon is formed in its cross-section into a parallelogram with adjoining sides crossing one another at other than 90 degrees. The deflection coil is produced by winding up in layers the wire ribbon in a plurality of coil grooves of a coil-winding frame die while the wire ribbon is delivered out from a nozzle, obliquely against the side wall face of each coil groove.

15 Claims, 8 Drawing Sheets

DEFLECTION COIL AND FABRICATION METHOD THEREOF

This is a continuation of application Ser. No. 08/049,730, filed on Apr. 20, 1993, now abandoned.

BACKGROUND OF THE INVENTION

1. Field of the Invention

The present invention relates to a deflection coil mounted on a deflection yoke for regulating the progressive direction of electric beams emitted from an electron gun for use in television receivers, display units or the like, and a fabrication method thereof.

2. Description of the Prior Art

In recent years, development of high resolution television receivers increasingly tends to require strict specifications relating to color mismatching, i.e., convergence of the cathode-ray tube screen. Under such tendency, it is earnestly desired that a deflection magnetic field be controlled more precisely. FIG. 1 shows an example of a bobbin for a saddle type deflection coil for use in a typical deflection yoke. The bobbin 2 is provided with a plurality of coil-winding grooves 5, on which, for example, a coil of wire 11 is wound in layers as shown in FIG. 2, to thereby form a deflection coil. The coil of wire 11 is formed from conductive wires (including litz wires) with an insulating layer 4 provided thereon which is coated with an adhesive about its periphery.

FIG. 2 is an enlarged view of one of the coil-winding grooves 5 shown in FIG. 1. In winding the coiling wire 11 on coil-winding grooves 5, the wire 11 is wound in layers by an automatic winding machine, one turn at a time, or several turns with the wires being unbundled or separated into single wires, whereby a deflection coil will be produced. Subsequently, the thus wound layered coil is energized with electricity, to heat and melt the adhesive applied about the insulating layer 4, so that the coil wires adhere to each other to form a deflection coil.

Such prior art deflection coil, however, suffers from difficulties: owing to variations in the stretching force acting on wire 11 as it is wound, and other reasons, the wire 11 is unequally displaced and biased as shown in FIG. 2. In other cases, the order of winding of wire 11 is altered and hence the desired winding pattern cannot be reliably achieved. Further, the bias of wire 11 forming the deflection coil differs from one coil to the next in mass production. Therefore, it would be impossible to regulate a deflection field with high precision with mass-produced coils. Additionally, mass-production makes the variation between coils larger, resulting in lowering of the yield, and hence the prior art winding method is disadvantageous in view of the cost. Even in the just-mentioned prior art method, the variations in the displacement and bias of wire 11 is reduced as the width of the coil-winding groove is narrowed to satisfy an original design, but this creates another problem of coil performance being deteriorated because of a reduced L/R ratio.

In order to eliminate such problems, the present applicant has previously proposed a deflection coil which is composed by forming a layer in which a plurality of adjoining conductive wires are arranged parallel in a row, and winding this layer in place of winding a single wire, turn by turn, as used to be practiced in the prior art.

Examples of layers (hereinafter called "wire ribbon") 15 include one that is composed as shown in FIG. 3A by arranging in parallel a plurality of conductive wires 8 of copper, aluminum or the like with an insulating layer 4 coated thereon, and adhering them using an adhesive 6; one that is composed as shown in FIG. 3B by arranging in parallel a plurality of conductive wires 8 with an insulating layer 4 coated thereon, and adhering together the wires on one side of an insulator sheet 7 of resin, etc., with an adhesive 6; one that is composed as shown in FIG. 3C by arranging and adhering together in parallel a plurality of conductive wires 8 formed with an insulating layer 4 and an adhesive layer 9; and one that is composed as shown in FIG. 3D by arranging a plurality of conductive wires in a contacting manner in a row, each wire being with an insulating layer 4 covered by a thermoplastic adhesive layer 20.

The conductive wires 8 forming the aforementioned wire ribbon 15 are arranged in parallel with one another in an orderly manner in a row, and therefore, each conductive wire 8 will not be displaced in wire ribbon 15, nor will the order of the wires be altered. As a result, by developing a deflection coil having a structure pertinent to using the thus constructed wire ribbon 15, it can be expected to produce a deflection coil free from the problems such as significant displacement of the conductive wires, and the like.

The present applicant herein has previously proposed a deflection coil in which wire ribbon 15 is wound in layers such that the cross-section of the layers forms a rectangular shape. The rectangular shape of the cross-section of wire ribbon 15 can be achieved as shown in FIG. 4 by forming bottom faces 10 of coil-winding grooves 5 having flanges 3 to make right angles with corresponding flange faces 13, and winding wire ribbon 15 in layers in parallel with the bottom face 10. The deflection coil formed with the wire ribbon 15 can be remarkably improved in its characteristics as compared with those in the prior art.

Meanwhile, when wire ribbon 15 is inserted into coil-winding groove 5, the width of wire ribbon 15 would ideally be the same with that of coil-winding groove 5, but in practice of insertion, the width of wire ribbon 15 exhibits dispersion, so that wire ribbon 15 may possibly be wider than the groove. In such a case, the wire ribbon 15 would be deformed to be inserted into coil-winding groove 5. Accordingly, a margin or clearance would be provided between wire ribbon 15 and each side wall face of groove 5.

Nevertheless, if there exists such a clearance as mentioned above when wire ribbon 15 is inserted in coil-winding groove 5, there is a concern that side ends of layered wire ribbons 15 would not be flush to one another, as shown in FIG. 5, because of being wound in a nesting manner when wire ribbon 15 is wound in layers. Such nesting layers of wire ribbon 15 might make it difficult to realize precise control of a deflection magnetic field formed by the deflection coil.

Further, as shown in FIG. 4, when the aforementioned wire ribbon 15 is wound in this manner in layers on each of coil-winding grooves 5 formed on bobbin 2, all the cross-sections of layered coils of wire ribbon 15 become rectangular. Accordingly, neighboring coil-winding grooves 5 create on their sides of bottom faces 10 useless step portions 14 that would have no wound coil, and wire ribbon 15 forms spaces 12 inside coil-winding groove 5 as shown in FIG. 5. In addition, there occurs a concern that the grooves to be formed on the bobbin becomes less in number since the grooves require large groove widths. These problems lower the space factor of wires for the deflection coil, and the presence of the step portions would make assembly more difficult when the coil is fabricated into a deflection yoke.

If the width of coil-winding grooves 5 and the width of wire ribbon 15 are made smaller in order to reduce irregularity or nesting of layers of wire ribbon 15 as much as possible, the precision of a winding machine for winding wire ribbon 15 into coil-winding groove 5 must be greater, and this requires that the input data for the winding machine should additionally include, for example, the sequence of identifying positions in which wire ribbon 15 is wound and other factors, thus expanding the input data to become more complicated. This method also presents difficulty in preparing forming dies for bobbins and metal dies for sizes of coil wires.

SUMMARY OF THE INVENTION

The present invention has been achieved to solve the above problems, and it is an object of the present invention to provide a deflection coil and a fabrication method thereof wherein electrically conductive wires are prevented from being displaced or disturbed in their order by using a wire ribbon for coil conductive wires forming the deflection coil, and wherein the wire ribbon is prevented from being wound in nesting manner, and therefore high dimensional precision and improved space factor of the coil can be achieved.

In order to achieve the above object, according to the present invention, there is provided a deflection coil which is formed in a saddle shape by winding a wire ribbon in a plurality of layers such that said layered wire ribbon is formed in its cross-section into a parallelogram with adjoining sides crossing one another at other than 90 degrees.

Further, in order to achieve the above object, according to the present invention, there is provided a fabrication method of a deflection coil for forming a deflection coil into a saddle shape by winding in plural layers a wire ribbon in coil grooves of a coil-winding frame die while the wire ribbon is delivered out from a nozzle, comprising the steps of: delivering from the nozzle the wire ribbon obliquely against the side wall face of the coil groove; and winding up the wire ribbon into the coil grooves in layers.

As described above, in accordance with the invention, in forming a saddle-shaped deflection coil by winding in layers the wire ribbon into the coil grooves formed in a coil-winding frame die of saddle shape while the wire ribbon is being delivered out from a nozzle, the wire ribbon is wound around into the coil grooves while delivered out obliquely against the side wall of the coil groove so that both sides of the wire ribbon necessarily abut against the respective side walls of the groove. By this method, it is possible to prevent the coil conductive wires from being displaced in the wire ribbon, as well as to prevent the coil conductive wires from being altered in their order. In addition, it is possible to wind up the wire ribbon into coil grooves having a width of not more than that of the wire ribbon, preventing the wire ribbon from being wound up in nested fashion, and positioned by the groove side walls. As a result, it is possible to produce a saddle type deflection coil extremely excellent in its dimensional accuracy and space factor of coil wires. Accordingly, an accurate control of a deflection magnetic field can be realized.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENT

Figure 1:
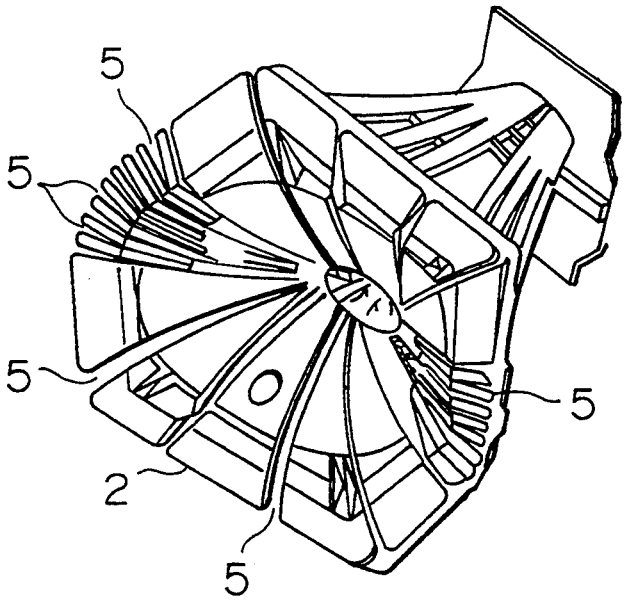
FIG. 1 PRIOR ART
FIG. 1 is a schematic perspective view showing an example of a bobbin used in a conventional deflection coil.
Figure 2:
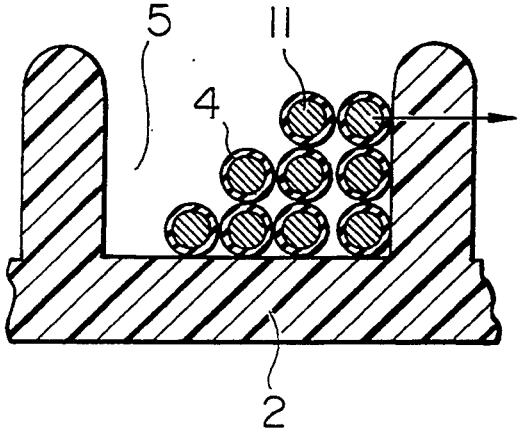
FIG. 2 PRIOR ART
FIG. 2 is an illustration showing a state of coil-windings in a conventional deflection coil.
Figure 3A:
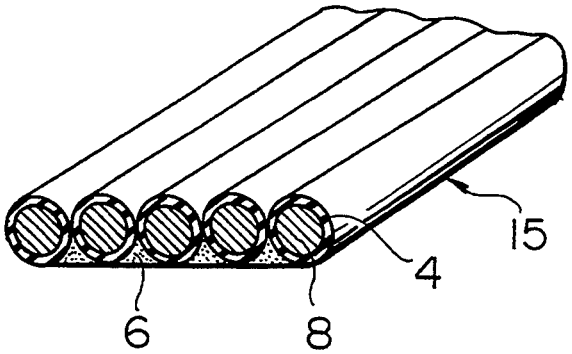
FIG. 3A PRIOR ART
FIGS. 3A to 3D are schematic perspective or sectional views showing different types of conventional wire ribbons.
Figure 3B:
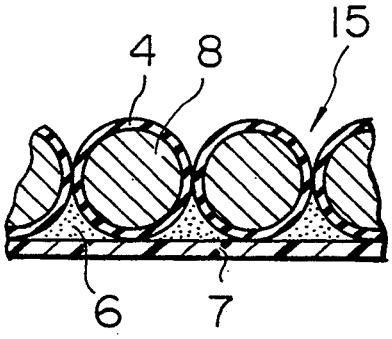
FIG. 3B PRIOR ART
Figure 3C:
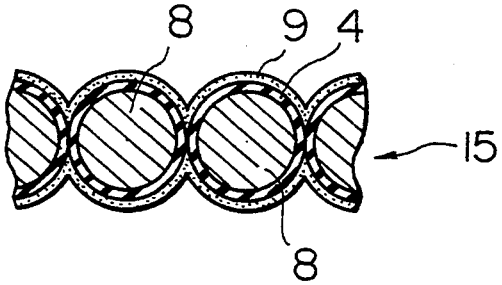
FIG. 3C PRIOR ART
Figure 3D:
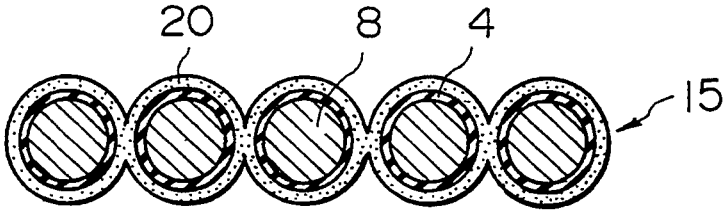
FIG. 3D PRIOR ART
Figure 4:
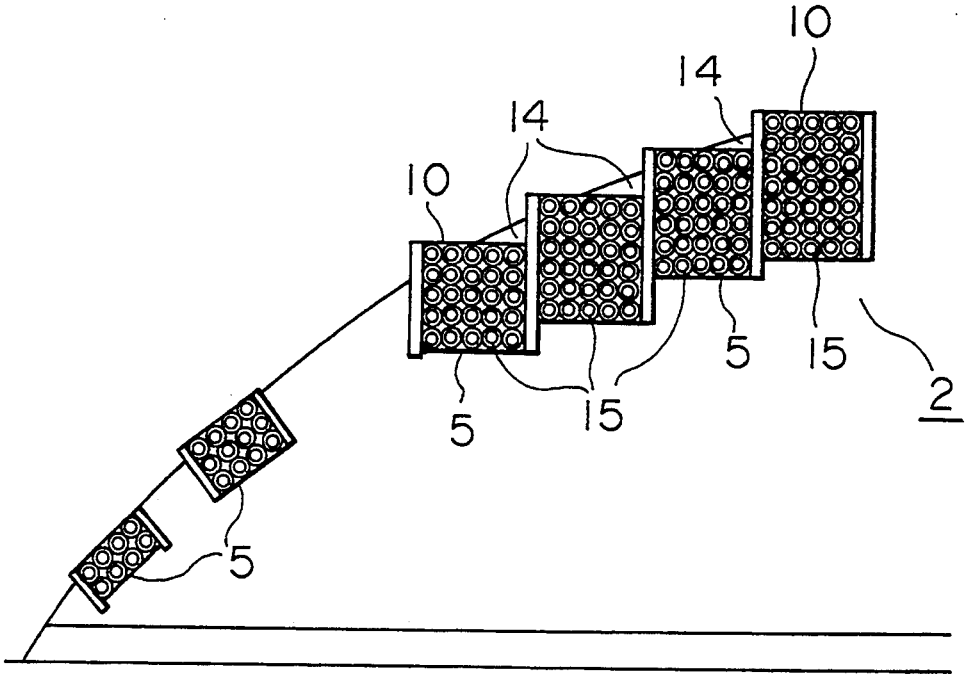
FIG. 4 PRIOR ART
FIG. 4 is a partial illustration of a deflection coil formed by winding a conventional wire ribbon in layers.
Figure 5:
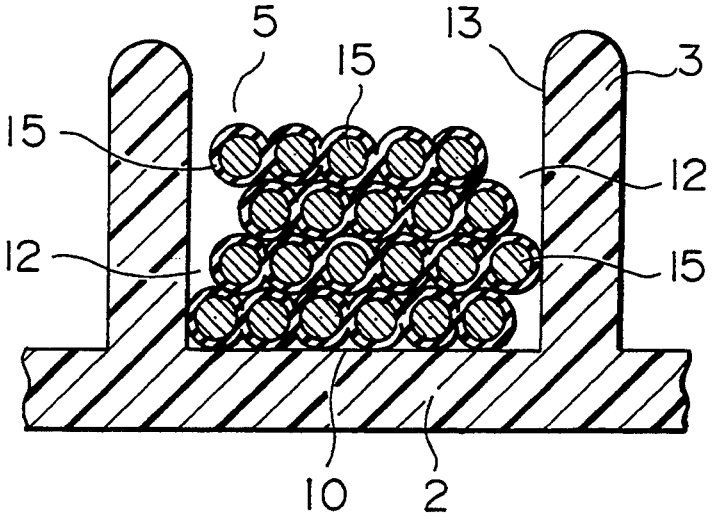
FIG. 5 PRIOR ART
FIG. 5 is an enlarged cross-sectional view showing a coil-winding groove portion shown in FIG. 4.
Figure 6:
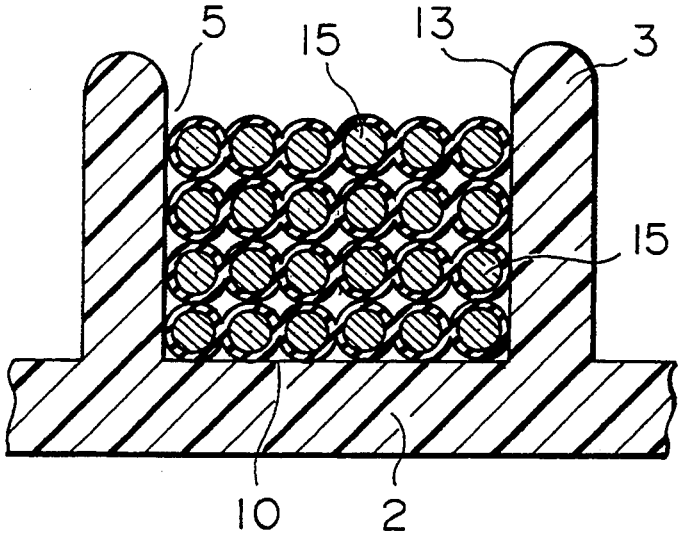
FIG. 6 PRIOR ART
FIG. 6 is a cross-sectional view of a deflection coil showing an ideal layered state of conventional wire ribbon.
Figure 7:
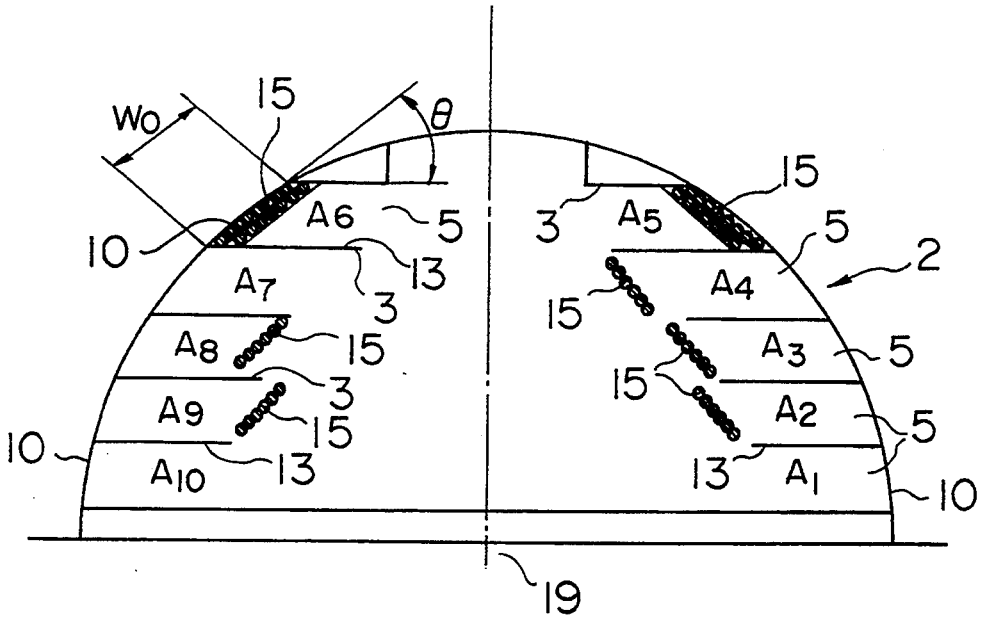
FIG. 7 is a schematic illustrative view showing a wire ribbon being wound in layers in a saddle type deflection coil in accordance with an embodiment of the present invention.

The present invention will be further described in detail with reference to some preferred embodiments shown in the accompanying drawings (FIGS. 7 to 15). In the drawings, like reference numerals will be allotted for the same parts with those in the aforementioned conventional example, and the detailed description for these parts will not be repeated. FIG. 7 is a schematic illustrative view showing a state of wire ribbon being wound in layers in a saddle type deflection coil in accordance with an embodiment of the present invention. The characteristic feature of this embodiment lies in that a wire ribbon 15 is inserted obliquely against a flange face (a side wall face) 13 of a coil-winding groove 5 disposed in a bobbin 2 while wound in layers so that the layered wire ribbon 15 is formed in its cross-section into a non-rectangular parallelogram, or with adjoining sides intersecting one another at other than 90 degrees (this parallelogram will hereinafter be abbreviated as a "non-rectangular parallelogram") and the other configurations are the same as those in the prior art.

Figure 8:
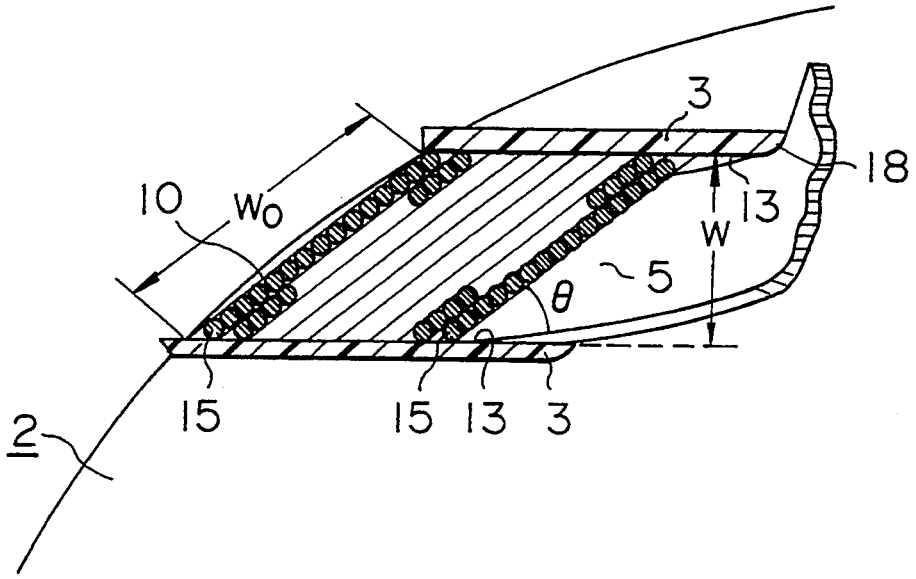
FIG. 8 is an enlarged view showing a coil-winding portion of the deflection coil shown in FIG. 7.
Figure 9:
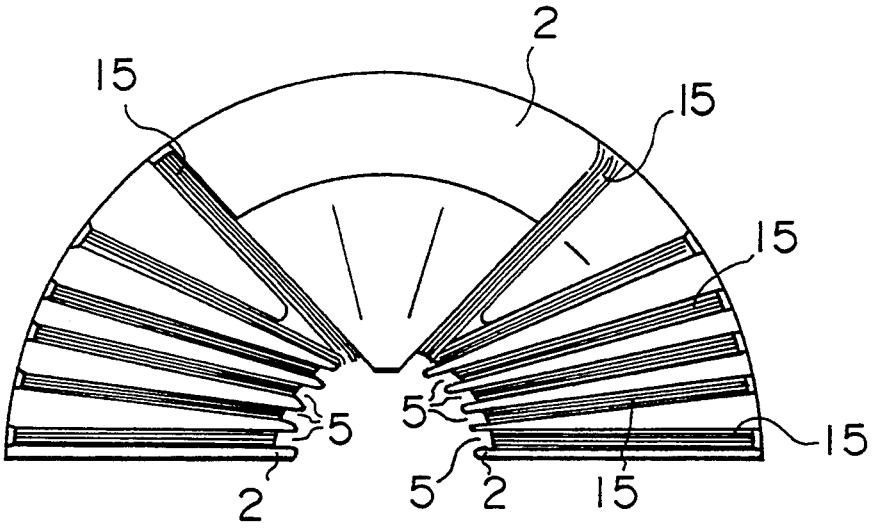
FIG. 9 is an illustration of a saddle type deflection coil in accordance with an embodiment of the present invention.

In FIG. 7, saddle-shaped bobbin 2 is provided with a plurality of coil-winding grooves 5 ($A_1$ to $A_{10}$) having flanges 3. The bottom faces 10 of coil-winding grooves 5 designated by $A_1$ and $A_{10}$ in the bottom base portion 19 of bobbin 2 are formed such as to make an angle approximately close to a right angle against flange faces (side wall face of grooves) 13, and the angle gradually becomes smaller than 90 degrees toward the portions of coil-winding grooves 5 designated by $A_5$ and $A_6$. The angles for the grooves $A_5$ and $A_6$ are set at about 40 degrees. On the other hand, the widths of coil-winding grooves 5 become narrower successively from grooves $A_1$ and $A_{10}$ toward grooves $A_5$ and $A_6$. The width W of the coil-winding groove is related to the wire ribbon 15 as shown in FIG. 8. That is, a relation $W = W_0 \text{ sine } \Theta$ holds where W, $W_0$, and $\Theta$ designate the width of coil-winding groove 5, the width of wire ribbon 15, and an inclination angle formed between flange face 13 and bottom face 10, respectively. Therefore, it is possible to make the width of coil-winding groove 5 less than that of wire ribbon 15.

In winding wire ribbon 15 into these coil-winding grooves 5, wire ribbon 15 is inclined obliquely against flange face 13 so that the wire ribbon can be wound smoothly into any of coil-winding grooves 5. In the present embodiment, the inserting angle of wire ribbon 15 into the groove is taken as 45 degrees against flange face 13.

Flange 3 of the aforementioned coil-winding groove 5 is formed with a rounded face 18 in the inside of its tip, as shown in FIG. 8. With this smoothing treatment of rounded face 18, wire ribbon 15 can be inserted smoothly in a more assured manner into coil-winding groove 5. The wire ribbon 15 is successively wound in layers around coil-winding groove 5, to form a cross-section of layered wire ribbon 15 into a non-rectangular parallelogram.

Figure 11A:
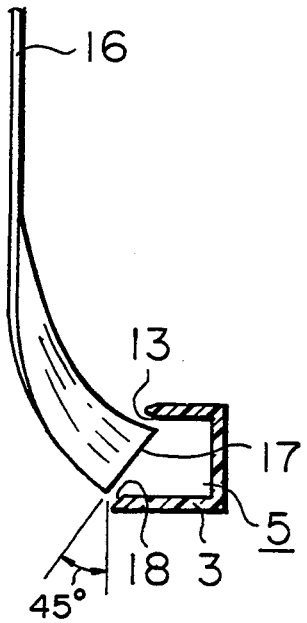
FIGS. 11A and 11B are illustrative views depicting a wire ribbon being inserted in a wire-winding groove in the same saddle type deflection coil.
Figure 11B:
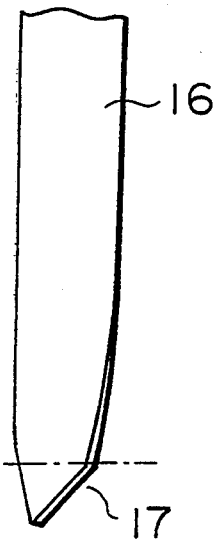

Next, working operations in manufacture of a saddle type deflection coil will be described in accordance with the present embodiment. FIGS. 11A and 11B show a nozzle slot 16 for manufacturing a saddle type deflection coil in accordance with this embodiment. Provided on a base side A of the nozzle slot 16 is a rotary shaft (not shown), which rotates to allow a tip portion 17 of nozzle slot 16 to rotate freely in any direction. The aforementioned wire ribbon 15 is delivered out through nozzle slot 16, and tip portion 17 of the nozzle slot 16 is fixed inclined 45 degrees against flange face (side wall face of groove) 13 of coil-winding groove 5. When a wire ribbon 15 having a width of more than that of coil-winding groove 5 is inserted into the coil-winding groove 5 from the nozzle tip portion 17, the wire ribbon 15 is delivered smoothly into coil-winding groove 5 with the help of rounded face 18 of flange 3 while remaining inclined 45 degrees against flange face 13, whereby the wire ribbon 15 is wound up in layers successively without forming any space on both sides of wire ribbon 15 in coil-winding groove 5. Thus, wire ribbon 15 is wound in layers to have its cross-section be a non-rectangular parallelogram.

In this manner, wire ribbon 15 is wound up in layers, successively for example, in the grooves 5 of $A_1$ to $A_5$ of bobbin 2 shown in FIG. 7. Subsequently, when the winding enters the groove 5 designated by $A_6$, the tip portion 17 of nozzle slot 16 is rotated 180 degrees about the nozzle rotary shaft on the base side A of nozzle slot 16 as a supporting point thereof. With this rotation, the inclined direction of wire ribbon 15 becomes opposite to that for the grooves $A_1$ to $A_5$, but the inserted angle of wire ribbon 15 against flange face 13 is unchanged at 45 degrees. In this orientation, wire ribbon 15 is wound up into layers successively from the groove 5 of $A_6$ to the groove 5 of $A_{10}$, to form a saddle-shaped deflection coil shown in FIG. 9. After this, the wire ribbon 15 is formed into a unitary structure by heating the wire ribbon 15 with electrical power to fuse and solidify it. Alternatively, the wire ribbon 15 is formed into a single structure by injecting a filler type resin into the layered coil. Thus a saddle type deflection coil can be formed. In this regard, a side view of nozzle slot 16 and a front view of the same are shown in FIGS. 11A and 11B, respectively.

According to this embodiment, since wire ribbon 15 is wound up in layers to form a saddle type deflection coil, neither will single conductive wires be displaced in wire ribbon 15, nor will the order of the wires be altered. Further, the saddle type deflection coil is prepared by winding up layers of wire ribbon 15 which, while being delivered, are kept inclined against flange face 13 from nozzle slot 16 and successively inserted into coil grooves 5 that have a width equal to or less than that of wire ribbon 15, so that both sides of wire ribbon 15 are abutted against flange faces 13 of coil-winding grooves 5, to thereby be restricted in position. By this restriction, it is possible to wind up layers of wire ribbon 15 in accordance with an original design instruction, preventing layers of wire ribbon 15 from being nested, so as not to leave any space or clearance between both sides of wire ribbon 15 and flange faces 13 of a coil-winding groove 5. In addition, it is possible to increase coil-winding grooves in number by making the width of a groove narrow, to remarkably improve the space factor of the deflection coil. Accordingly, an accurate control of a deflection magnetic field can be realized.

As a wire ribbon 15 having a width of more than that of coil-winding groove 5 is wound up in layers while being inserted obliquely against flange face 13 of coil-winding groove 5 disposed in bobbin 2 and the layered wire ribbon 15 is formed in its cross-section into a non-rectangular parallelogram, both sides of wire ribbon 15 are abutted against flange faces 13 of coil-winding groove 5. As a result, it is no longer necessary to impose a strict dimensional tolerance on the width of coil-winding groove 5 when it is produced, and therefore, the manufacture of bobbin forming dies and/or wire-winding metal dies can be simplified.

Further, since there will be no need for a sequence such as to confirm turn by turn the winding position of wire ribbon 15, the allowable precision of the winding machine to be used can be widened, and therefore the time for inputting specifications of the winding wire used into the winding machine can be reduced.

In addition, it is possible to form a smooth peripheral surface of the coil by eliminating steps that would be formed on the peripheral surface of the coil. Accordingly, assembly processes for the deflection coil may be improved.

It should be noted that the present invention is not limited to the above embodiment, but various practical configurations can be adopted. For example, though the shape of bottom face 10 of coil-winding groove 5 is not limited particularly in the above embodiment, bottom face 10 may be formed into any shape such as, for example, flat as shown in FIG. 12A, or can be arc-shaped as shown in FIG. 12B.

Figure 12A:
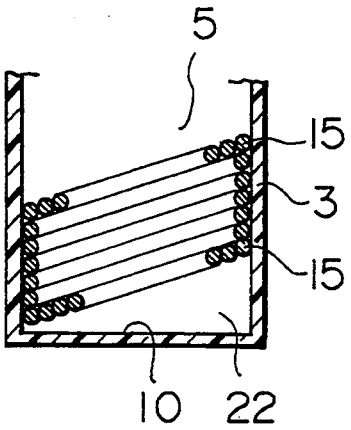
FIGS. 12A and 12B are illustrative views showing bottom shapes of a coil-winding groove in a saddle type deflection coil in accordance with an embodiment of the present invention.
Figure 12B:
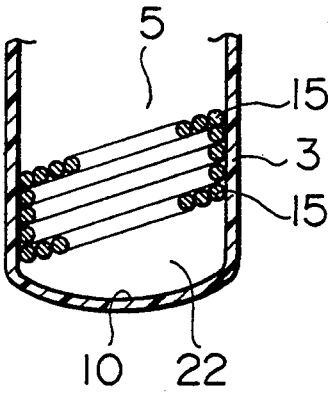
Figure 13A:
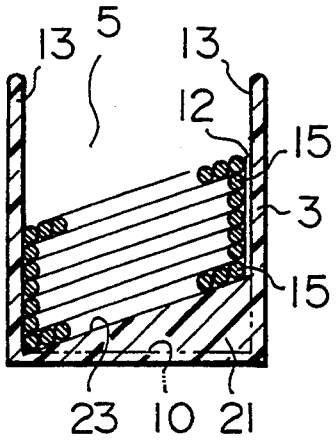
FIGS. 13A to 13C are illustrative views showing different slope shapes of coil-winding grooves in a saddle type deflection coil.
Figure 13B:
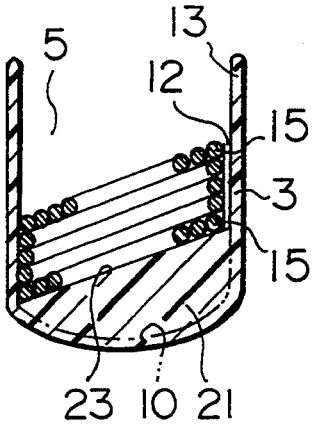
Figure 13C:
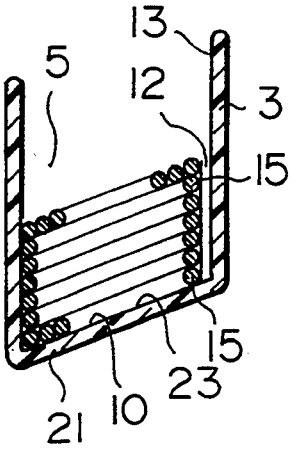

A slant face 23 can be formed in advance with a base member 21 of an insulating material or the like, as shown in FIGS. 13A and 13B, for filling the portion of a space 22 formed between bottom face 10 of coil-winding groove 5 and wire ribbon 15 shown in FIGS. 12A and 12B. It is also possible to form the bottom face 10 itself into a slant face 23 as shown in FIG. 13C. An extremely slight margin 12 relatively smaller than that in the referenced example is preferably provided between flange face 13 and the side end of wire ribbon 15, although it is not essential. In this case, when wire ribbon 15 is wound up in layers in coil-winding groove 5, wire ribbon 15 may abut against, and be positioned by, one of flange faces 13 and bottom face 10 despite the margin 12 being provided, and since the margin is extremely small, wire ribbon 15 can be smoothly wound up in layers with the help of the slight clearance, without being wound up in a nested manner.

Figure 10:
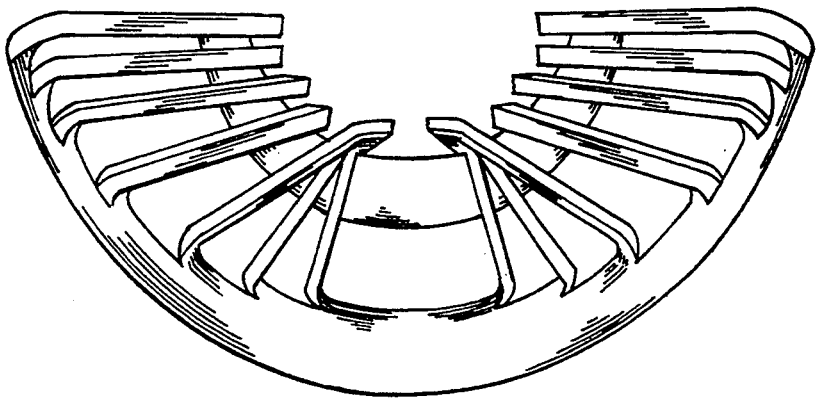
FIG. 10 is an illustration showing a saddle type deflection coil of the invention after the separation from a wire-winding metal die.
Figure 14:
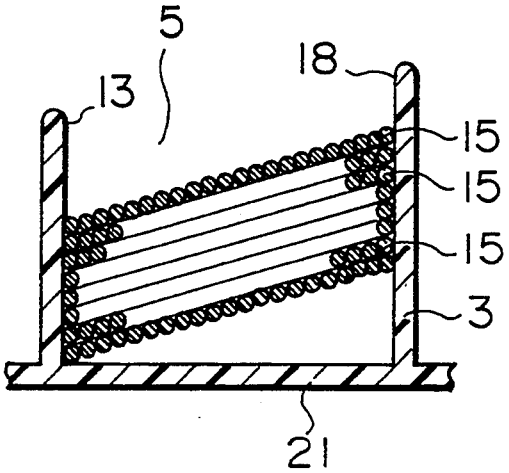
FIG. 14 is an illustrative view showing a wire ribbon being wound in layers into a coil-winding groove in a wire-winding metal die for the same saddle type deflection coil.

In the above embodiment, wire ribbon 15 is wound up in layers on coil-winding groove 5 of bobbin 2 to be formed into a deflection coil having a layered cross-section of a non-rectangular parallelogram, but as shown in FIG. 14, for example, wire ribbon 15 can be developed into a unitary structure by heating with electrical power to fuse and solidify the coil or by hardening it with a filler type resin, after having been wound up in layers on coil-winding groove 5 of a wire-winding metal die 21 to form a layered section of a parallelogram. The thus integrated layered coil may be separated from wire-winding metal die 21 to form a saddle type deflection coil as shown in FIG. 10.

Figure 15:
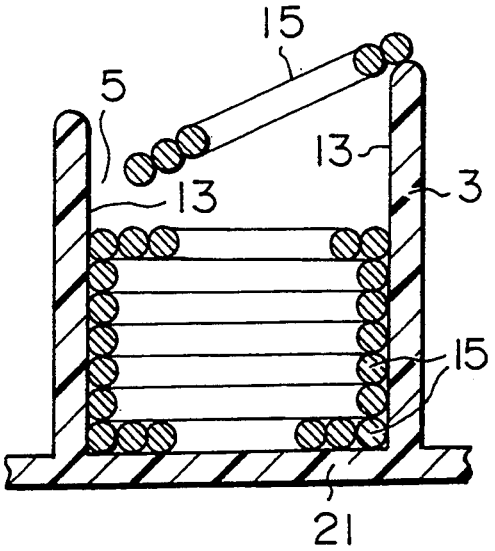
FIG. 15 is an illustrative view showing a winding wire in which a wire ribbon is formed in layers such that the layered cross-section is rectangular.

In the above embodiment, the cross-section of wire ribbon 15 being wound up in layers on coil-winding groove 5 of bobbin 2 is formed into a non-rectangular parallelogram. If, for example, wire ribbon 15 is as wide as coil-winding groove 5, wire ribbon 15 can be smoothly inserted into the groove 5 and wound up by inserting wire ribbon 15 perpendicularly against flange face 13, to thereby form a coil having a layered cross-section of a rectangle as shown in FIG. 15. In this case, wire ribbon 15 is positioned abutting in its both sides against flange faces 13, so that wire ribbon 15 may not be wound in layers in a nested manner. As a result it is possible to form a deflection coil having a high space factor of coil free from waste of space.

What is claimed is:

1. A deflection coil preformed into a saddle shape comprising a plurality of layers of conductive wire ribbon layered atop each other and against a spacer in the bottom of a coil groove wherein, a cross-section taken along a right angle to said layered wire ribbon forms a non-rectangular parallelogram with adjoining sides intersecting one another at other than 90 degrees.

2. A method of producing a deflection coil formed into a saddle shape by providing a coil-winding frame die including a plurality of coil grooves into which plural layers of a wire ribbon are wound, each of said plurality of coil grooves having a pair of side wall faces and a spacer located adjacent a bottom face, said wire ribbon being delivered from a nozzle, the method comprising the steps of:

delivering said wire ribbon from said nozzle adjacent to and aligned with said spacer such that said wire ribbon forms an oblique angle with respect to at least one of said side wall faces when said wire ribbon comes to rest; and winding said wire ribbon into said coil grooves in layers with successive layers being parallel to each other and a first layer adjacent said spacer.

3. A method of producing a deflection coil according to claim 2, wherein the width of said coil groove is smaller than that of said wire ribbon and wherein the winding step includes winding said wire ribbon in layers without leaving a space between each of the side walls of the coil groove and each side of said wire ribbon.

4. A method of producing a deflection coil according to claim 2, wherein the tip end portion of said side wall face of said coil groove is formed with a rounded face and wherein the winding step includes smoothly inserting said wire ribbon into said coil groove.

5. The method of claim 3 further comprising the step of fusing said plural layers of wire ribbon to thereby form a unitary structure.

6. The method of claim 5 wherein said fusing step includes energizing said plural layers with electrical power to thereby fuse said layers together with heat generated by said electrical power.

7. The method of claim 6 wherein each of said wire ribbons has a heat deformable insulation surrounding its periphery and the fusing step includes the step of heat deforming said insulation on adjacent layers of wire ribbon to thereby fuse them.

8. The method of claim 2 wherein said winding step includes the step of winding each successive layer of wire ribbon at the same oblique angle and closely adjacent to each prior layer to thereby create a deflection coil having a cross-sectional shape of a non-rectangular parallelogram.

9. The method of claim 8 wherein said coil grooves are of varying width and wherein the winding step includes the step of winding the layers of wire ribbon at any oblique angle, with respect to said at least one side wall face of said coil grooves, from one coil groove to another.

10. The method of claim 9 wherein the width of said coil groove is smaller than that of said wire ribbon and wherein the winding step includes winding said wire ribbon in layers without leaving a space between each of the side walls of the coil groove and each side of said wire ribbon.

11. The method of claim 10 further comprising the step of fusing said plural layers of wire ribbon to thereby form a unitary structure.

12. The method of claim 11 wherein said fusing step includes energizing said plural layers with electrical power to thereby fuse said layers together with heat generated by said electrical power.

13. A deflection coil preformed into a saddle shape comprising a plurality of conductive wire ribbons layered atop each other and against a spacer in the bottom of a groove with successively offset edges between adjacent layers so that said coil is thereby adapted for placement in a coil groove of a deflection yoke.

14. The deflection coil of claim 13 wherein said plurality of ribbons are fused to each other to thereby form a unitary structure.

15. The deflection coil of claim 14 wherein said degree of offset is chosen to match a coil groove having a particular width so that, when placed therein, said ribbons form an oblique angle with and extend from one side wall of said coil groove to the other side wall of said coil groove.

* * * * *